US008033262B2

(12) United States Patent
Morelli et al.

(10) Patent No.: US 8,033,262 B2
(45) Date of Patent: Oct. 11, 2011

(54) VALVE OPERATING SYSTEM FOR VARIABLE DISPLACEMENT INTERNAL COMBUSTION ENGINE

(75) Inventors: Anthony Morelli, Royal Oak, MI (US); John W. Robinson, Wixom, MI (US)

(73) Assignee: Ford Global Technologies, Dearborn, MI (US)

( * ) Notice: Subject to any disclaimer, the term of this patent is extended or adjusted under 35 U.S.C. 154(b) by 642 days.

(21) Appl. No.: 12/112,032

(22) Filed: Apr. 30, 2008

(65) Prior Publication Data

US 2009/0145390 A1 Jun. 11, 2009

Related U.S. Application Data

(60) Provisional application No. 60/992,382, filed on Dec. 5, 2007.

(51) Int. Cl.
*F01L 1/24* (2006.01)

(52) U.S. Cl. ..... 123/90.46; 123/90.48; 123/90.39

(58) Field of Classification Search ..... 123/90.16, 123/90.48, 90.52, 90.39
See application file for complete search history.

(56) References Cited

U.S. PATENT DOCUMENTS

| | | | | |
|---|---|---|---|---|
| 4,576,128 | A | 3/1986 | Kenichi | |
| 4,926,804 | A | 5/1990 | Fukuo | |
| 5,394,841 | A * | 3/1995 | Murakami | 123/90.15 |
| 5,778,842 | A * | 7/1998 | Schmidt et al. | 123/90.39 |
| 5,845,614 | A | 12/1998 | Tanaka et al. | |
| 6,830,018 | B2 * | 12/2004 | Sugimoto et al. | 123/90.11 |
| 2002/0014217 | A1 | 2/2002 | Church et al. | |
| 2005/0133003 | A1 | 6/2005 | Afjeh et al. | |
| 2006/0005796 | A1 | 1/2006 | Janak et al. | |
| 2007/0193543 | A1 | 8/2007 | Best | |
| 2008/0083385 | A1 | 4/2008 | Han et al. | |

FOREIGN PATENT DOCUMENTS

| | | |
|---|---|---|
| JP | 3-156113 | 7/1991 |
| WO | W02005/080762 A1 | 9/2005 |

* cited by examiner

*Primary Examiner* — Zelalem Eshete
(74) *Attorney, Agent, or Firm* — Jerome R. Drouillard; Julia Voutyras

(57) ABSTRACT

A cylinder valve operating system for a variable displacement internal combustion engine having poppet valves includes a cam arm driven by a camshaft and a valve arm selectively driven by the cam arm. A valve arm positioner, which may be hydraulically cushioned, adjustably maintains the valve arm in contact with the valve stem when the valve arm is not being driven by the cam arm, in order that the valve arm will be accurately located for speedy and precise linkage of the cam arm to the valve arm.

11 Claims, 3 Drawing Sheets

Figure 1
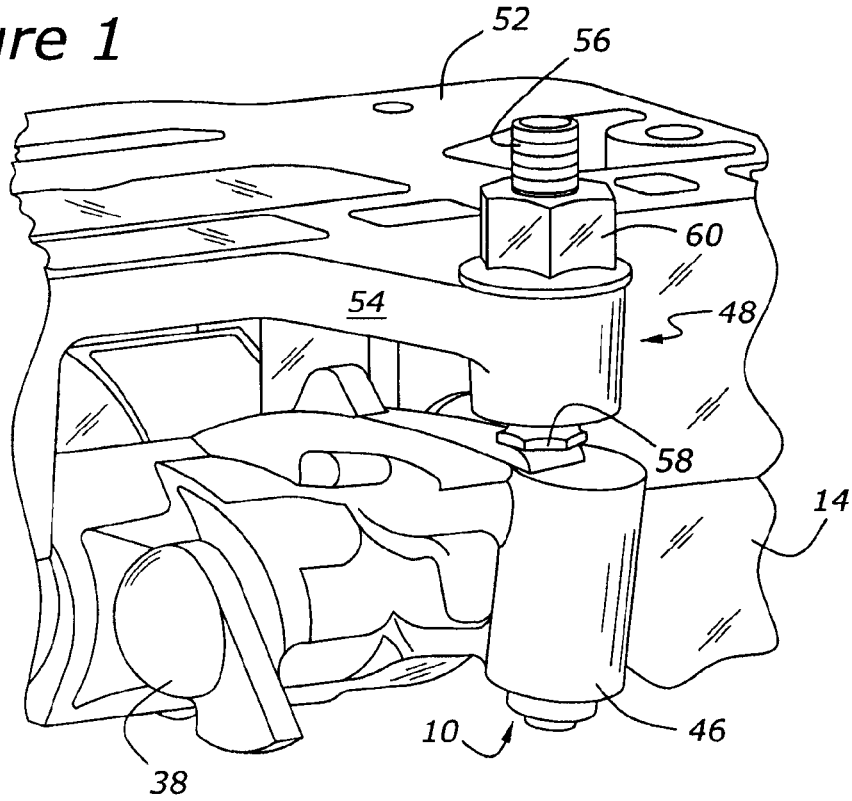
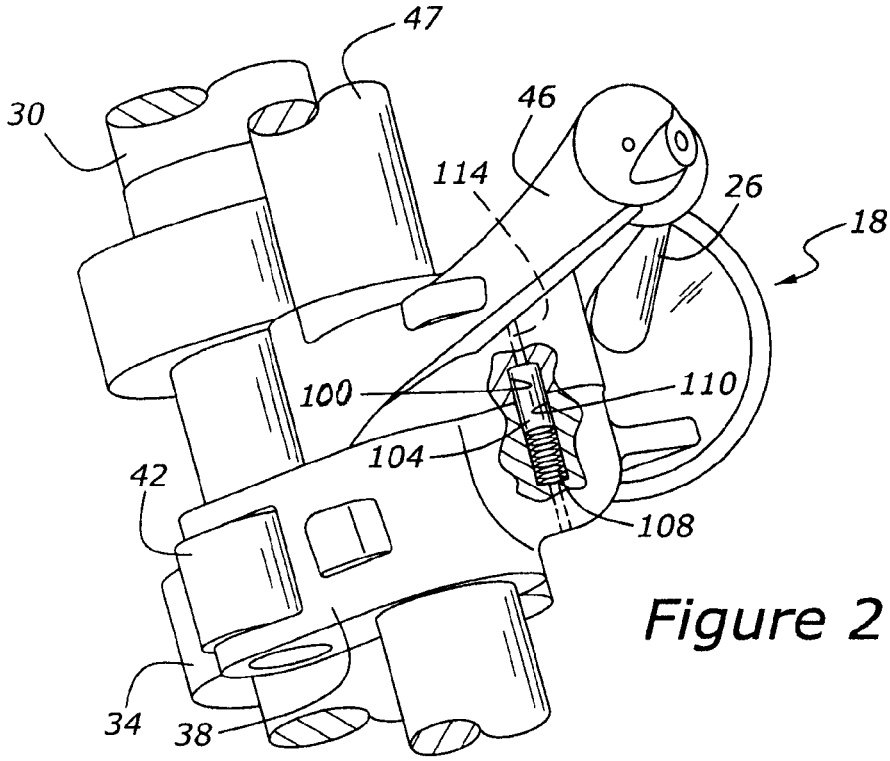
Figure 2

VALVE OPERATING SYSTEM FOR VARIABLE DISPLACEMENT INTERNAL COMBUSTION ENGINE

CROSS REFERENCE TO RELATED APPLICATIONS

The present application claims priority to U.S. provisional application entitled SET SCREW ADJUSTMENT DEVICE FOR HYDRAULIC VALVETRAIN TO SET ROCKER-ARM LOCATION having Ser. No. 60/992,382 and filed on Dec. 5, 2007.

BACKGROUND OF THE INVENTION

Field of the Invention

The present invention relates to a reciprocating internal combustion engine having one or more poppet valves which may be disabled so as to allow the engine to be operated with fewer than the total number of cylinders.

Variable displacement engines have been the subject of much inventive activity during the past several decades. Typically, variable displacement systems have included such devices as hydraulically and electromagnetically driven poppet valves, and yet more complicated systems for allowing cylinder poppet valves to be disabled in deactivated cylinders. Cylinder deactivation, in general, is desirable because the fuel economy of an engine may be enhanced by operating with fewer than the total number of cylinders allowing the engine to operate closer to an unthrottled condition.

It is known to use a variable displacement system in which rocker arms are mounted in pairs for a single valve, with one rocker arm contacting a lobe on a camshaft and a second rocker arm contacting the tip of a poppet valve stem. The connection between the two rocker arms is usually made with a sliding pin, which must be allowed to pass from one rocker arm into the other in a very short period of time, with much precision, so as to assure that the rocker arms are linked together and that the valve is, therefore, operable when desired. In order for the connection between the two rocker arms to be made accurately, it is required that the arm which contacts the poppet valve be precisely positioned prior to the linking of the two arms. It is not an acceptable solution to merely increase the size of the aperture which receives the locking pin, because this solution will lead to noise and durability concerns.

FIG. 6 shows a prior art rocker arm, 200, having a tail, 204, which contacts a circular cam lobe, 208. Tail 204 and lobe 208 are intended to precisely position rocker arm 200, so as to permit precise activation of arm 200 by a camshaft arm (not shown). A problem may be encountered when wear occurs, either with cam lobe 208 or on tail 204 of rocker arm 200, because rocker arm 200 may not be positioned with the precision needed to allow rapid and reliable engagement and disengagement of a locking pin from a second arm which receives an opening impulse from the camshaft.

It would be desirable to provide a system for reliably and durably locating a valve contacting rocker arm so as to allow precise and rapid lockup of adjacent arms in a variable displacement engine.

BRIEF DESCRIPTION OF THE INVENTION

According to an aspect of the present invention, a cylinder valve operating system for a reciprocating internal combustion engine includes a poppet valve having a valve head and a valve stem and a camshaft having a number of cam lobes. A cam arm is driven by one of the cam lobes. A valve arm, which is selectively driven by the cam arm, opens the poppet valve by engaging the valve stem. A valve arm positioner adjustably maintains the valve arm in contact with the valve stem when the valve arm is not being driven by the cam arm. The valve arm positioner preferably comprises an adjustable abutment configured to contact a bearing surface of the valve arm. The valve arm may also incorporate a hydraulic valve lash adjuster.

In a preferred embodiment, the valve arm positioner contacts the valve arm at a location proximate the portion of the valve arm which engages the valve stem.

According to another aspect of the present invention, the valve arm incorporates a hydraulic lash adjuster and also a hydraulic damping element, with the latter being incorporated within the valve arm so that an adjustable contactor mounted above the valve arm will contact the damping element. In this manner, movement of the valve arm in a direction away from the valve stem will be limited, but with a hydraulic damping component to the limiting force.

According to yet another aspect of the present invention, an adjustable abutment includes a threadably adjustable contactor mounted over the valve arm. The adjustable contactor may be supported by a ladder frame which also supports a rocker shaft to which the cam arm and the valve arm are journaled.

According to yet another aspect of the present invention, the valve arm positioner includes a hydraulically damped adjustable abutment having a hydraulic damping element incorporated within an adjustable contactor mounted above the valve arm. In this case, a hydraulically loaded damper cap is slidably mounted to a lower end of an adjustable cylindrical stud having a central oil passage.

According to another aspect of the present invention, an adjustable valve arm contactor includes a hydraulically damped adjustable abutment having a hydraulically loaded plunger incorporated within the valve arm, and an adjustable contactor mounted above the valve arm, whereby the adjustable contactor will contact the plunger when the valve moves to a closed position.

It is an advantage of a system according to the present invention that the present valve arm may be precisely located for accurate and rapid engagement and disengagement with a cam arm driven by one of the lobes on a camshaft.

It is another advantage of a system according to the present invention that noise associated with the operation of the valve arm positioner is mitigated by the use of hydraulically damped elements within the system.

It is yet another advantage of a system according to the present invention that the system may be used advantageously with a hydraulic lash adjustor incorporated in the valve arm.

It is yet another advantage of a system according to the present invention that wear problems inherent with prior art systems will be eliminated.

Other advantages, as well as features of the present invention, will become apparent to the reader of this specification.

BRIEF DESCRIPTION OF THE DRAWINGS

FIG. 1 is a perspective view of a variable displacement engine cylinder valve operating system according to the present invention.

FIG. 2 is an overhead perspective view of a portion of the present valve operating system.

DETAILED DESCRIPTION OF THE PREFERRED EMBODIMENTS

Figure 3:
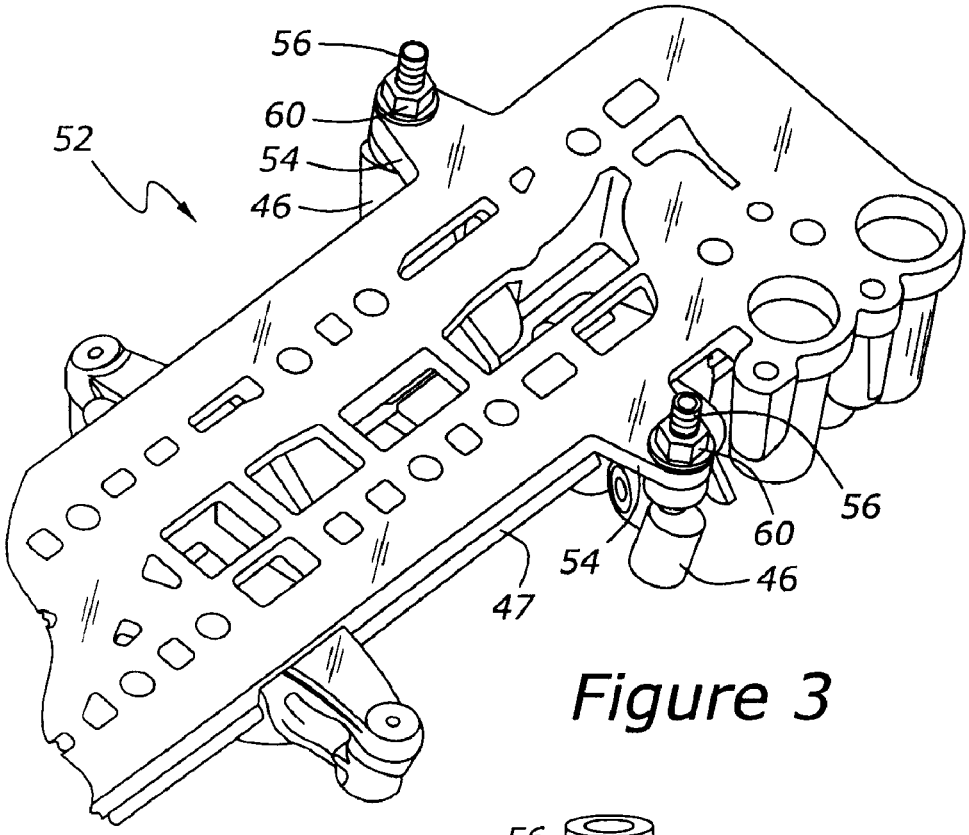
FIG. 3 is a perspective view of a ladder frame incorporating a valve operating system according to the present invention.

As shown in FIG. 1, a cylinder valve operating system, 10, is mounted upon a cylinder head, 14, of an engine. The system itself is contained within a ladder frame, 52, (FIG. 3) but those skilled in the art will appreciate in view of this disclosure that the present system could be employed not only with the illustrated ladder frame but with other structures such as camshaft caps having a cantilevered beam or mounting boss similar to beam 54, which provides a mounting position for valve arm positioner 48. Valve arm positioner 48 is shown in FIG. 1 as including a threadably adjustable contactor 56 and a locking nut 60. The lower portion of threadably adjustable contactor 56 has a head, 58, which contacts a load bearing surface on the upper surface of valve arm 46. Valve arm 46 has a hydraulic lash adjuster, shown at 64 in FIG. 4, which contacts the tip of valve stem 26 as shown in FIG. 2. FIG. 1 also shows a cam arm, 38, which is shown in greater detail in FIG. 2. Those skilled in the art will appreciate in view of this disclosure that threadably adjustable contactor 56 could be replaced with a contactor which is adjustable through the use of shims or other adjustment devices.

FIG. 2 shows a rocker shaft, 47, which provides a fulcrum for the mounting of valve arm 46 and cam arm 38. Cam arm 38 includes a roller, 42, which contacts a cam lobe, 34, carried upon camshaft 30. When cam lobe 34 provides a force input into cam arm 38, motion of cam arm 38 is transmitted to valve arm 46 only if pin 104, which is contained within bore 100 formed in valve arm 46, extends into bore 100 from housing bore 110, which is formed in cam arm 38. Note that spring 108 maintains pin 104 normally in an engaged position, except when oil pressure is provided through oil passage 114 within valve arm 46, sufficient to push pin 104 to an unlatched position. FIG. 2 also shows valve arm 46, poised to press down upon the tip of valve stem 26 so as to move valve 18 to an open position. FIG. 2 does not, however, show valve arm positioner 48.

Figure 4:
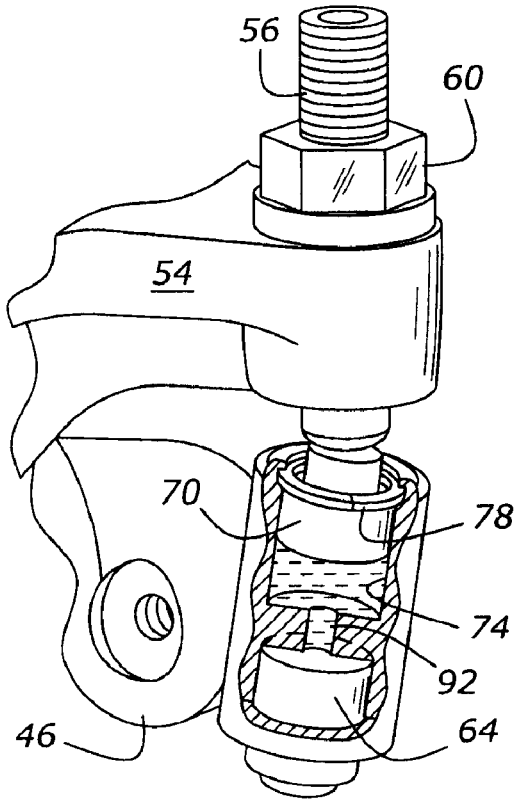
FIG. 4 is a perspective view of a valve operating system having hydraulic damping located within the valve operating arm.
Figure 5:
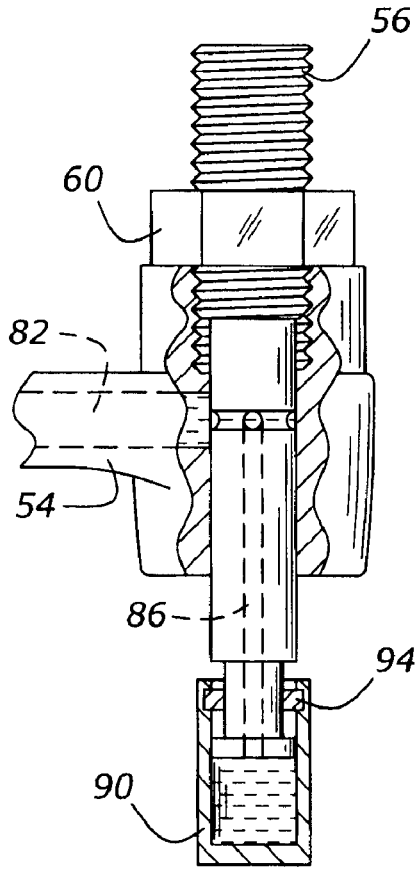
Figure 5 Prior Art
FIG. 5 is a perspective view of a valve operating system having hydraulic damping located within a valve arm positioner.
Figure 6:
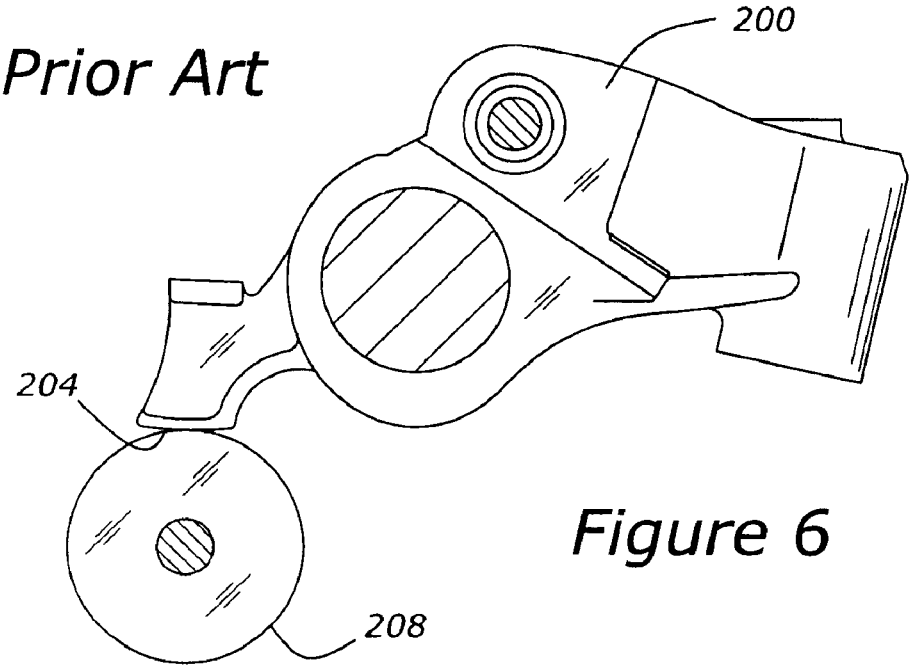
FIG. 6 illustrates a prior art valve actuating arm.

In the embodiment of valve arm positioner 48 shown in FIG. 1, there is no hydraulic damping associated with the operation of the valve arm positioner. Rather, the function of valve arm positioner 48 is performed predominantly by threadably adjustable contactor 56, which abuts the top surface of valve arm 46 in a mechanical fashion. FIGS. 4 and 5 illustrate hydraulic damping incorporated into the present system.

Moving to FIG. 4, valve arm 46, which is shown with hydraulic lash adjustor 64, has a plunger bore, 74, formed in a upper portion of valve arm 46. A hydraulically loaded plunger, 70, is housed in plunger bore 74 and maintained within plunger bore 74 by an internal snap ring, 78. Plunger bore 74 is provided with oil under pressure at substantially the same pressure as oil furnished to hydraulic lash adjustor 64 and, when valve arm 46 is in a valve-closed position, hydraulic lash adjustor 64 will urge arm 46 upwardly, causing plunger 70 to move downwardly within plunger bore 74 against the force of oil which is contained within plunger bore 74, perhaps until a point is reached where plunger 70 bottoms out within plunger bore 74, allowing adjustable contactor 56 to then maintain valve arm 46 in a specified position permitting accurate coupling and decoupling with cam arm 38.

FIG. 5 illustrates an embodiment which includes a damper cap, 90, which is slidably mounted to a lower end of an adjustable cylindrical stud shown at 56. An oil passage 86 within stud 56 provides oil under pressure to the interior of cap 90, allowing cap 90 to be pushed downwardly until internal snap ring 94 prevents further movement of cap 90 so that when valve arm 46 is decoupled from cam arm 38 and hydraulic lash adjuster 64 pushes valve arm 46 upwardly, oil will be bled back through passage 86 or around the periphery of the joint between stud 56 and the inside diameter of cap 90 so that, in effect, a soft landing will be made by rocker arm or valve arm 46 against stud 56. At the same time, valve arm 46 will be positioned for accurate coupling or decoupling with cam arm 38.

The foregoing invention has been described in accordance with the relevant legal standards, thus the description is exemplary rather than limiting in nature. Variations and modifications to the disclosed embodiment may become apparent to those skilled in the art and fall within the scope of the invention. Accordingly the scope of legal protection afforded this invention can only be determined by studying the following claims.

What is claimed is:

1. A cylinder valve operating system for an internal combustion engine comprising:

a poppet valve having a valve head and a valve stem;

a camshaft having a plurality of cam lobes;

a cam arm driven by one of said cam lobes;

a valve arm selectively driven by said cam arm for opening said poppet valve by engaging the valve stem; and a valve arm positioner for adjustably maintaining the valve arm in contact with the valve stem when the valve arm is not being driven by the cam arm and the valve is closed, wherein said valve arm positioner comprises an adjustable abutment with a threadably adjustable contactor located over the portion of the valve arm which contacts the valve stem and configured to contact a load bearing surface of the valve arm, with said adjustable contactor being attached to a ladder frame mounted to a cylinder head of an engine.

2. A cylinder valve operating system according to claim 1, wherein said valve arm positioner contacts the valve arm at a location proximate the portion of the valve arm which engages the valve stem.

3. A cylinder valve operating system according to claim 1, wherein said valve arm incorporates a hydraulic lash adjuster.

4. A cylinder valve operating system according to claim 3, wherein said valve arm positioner contacts the valve arm at a location selected to balance force imposed upon the valve arm by the hydraulic lash adjuster.

5. A cylinder valve operating system according to claim 1, wherein said ladder frame supports at least one rocker shaft to which said cam arm and said valve arm are journaled.

6. A cylinder valve operating system for an internal combustion engine comprising:

a poppet valve having a valve head and a valve stem;

a camshaft having a plurality of cam lobes;

a cam arm driven by one of said cam lobes;

a valve arm selectively driven by said cam arm for opening said poppet valve by engaging the valve stem, with said valve arm having a hydraulic lash adjuster for engaging the valve stem; and a valve arm positioner for adjustably maintaining the valve arm in contact with the valve stem when the valve arm is not being driven by the cam arm and the valve is closed, with said valve arm positioner having an adjustable contactor located over the portion of the valve arm which contacts the valve stem, whereby movement of the valve arm in a direction away from the valve stem will be limited.

7. A cylinder valve operating system according to claim 6, wherein said valve arm positioner is hydraulically damped.

8. A cylinder valve operating system according to claim 6, wherein said adjustable contactor comprises a hydraulically damped adjustable abutment having a hydraulically loaded plunger incorporated within said valve arm and an adjustable contactor mounted above the valve arm, whereby the adjustable contactor will contact the plunger when the valve moves to a closed position.

9. A cylinder valve operating system according to claim 6, wherein said valve arm positioner comprises a hydraulically damped adjustable abutment having a hydraulic damping element incorporated within an adjustable contactor mounted above the valve arm.

10. A cylinder valve, operating system according to claim 9, wherein said adjustable contactor comprises a hydraulically loaded damper cap, slidably mounted to a lower end of an adjustable stud having a central oil passage for furnishing oil under pressure to a variable volume defined by the interior of said cap.

11. A cylinder valve operating system for an internal combustion engine comprising:

a poppet valve having a valve head and a valve stem;

a camshaft having a plurality of cam lobes;

a cam arm driven by one of said cam lobes;

a valve arm selectively driven by said cam arm for opening said poppet valve by engaging the valve stem, with said valve arm having a hydraulic lash adjuster for engaging the valve stem; and a valve arm positioner for adjustably maintaining the valve arm in contact with the valve stem when the valve arm is not being driven by the cam arm and the valve is closed, with said valve arm positioner having an adjustable hydraulically damped contactor located over the portion of the valve arm which contacts the valve stem, whereby movement of the valve arm in a direction away from the valve stem will be limited.

* * * * *